US009597259B2

(12) United States Patent
Becker

(10) Patent No.: US 9,597,259 B2
(45) Date of Patent: Mar. 21, 2017

(54) STORAGE OR INFUSION BOTTLE

(71) Applicant: WEST PHARMACEUTICAL SERVICES DEUTSCHLAND GMBH & CO. KG, Eschweiler (DE)

(72) Inventor: Bernd Becker, Aachen (DE)

(73) Assignee: KOCHER-PLASTIK MASCHINEBAU GMBH, Sulzbach-Laufen (DE)

( * ) Notice: Subject to any disclaimer, the term of this patent is extended or adjusted under 35 U.S.C. 154(b) by 0 days.

(21) Appl. No.: 14/784,109

(22) PCT Filed: Apr. 18, 2013

(86) PCT No.: PCT/EP2013/001149
§ 371 (c)(1),
(2) Date: Oct. 13, 2015

(87) PCT Pub. No.: WO2014/169929
PCT Pub. Date: Oct. 23, 2014

(65) Prior Publication Data
US 2016/0067142 A1 Mar. 10, 2016

(51) Int. Cl.
*A61J 1/14* (2006.01)

(52) U.S. Cl.
CPC ..... *A61J 1/1406* (2013.01); *A61J 1/1412* (2013.01); *A61J 1/1431* (2015.05); *A61J 1/1475* (2013.01); *A61J 1/1493* (2013.01)

(58) Field of Classification Search
CPC ..... A61J 1/1406; A61J 1/1431; A61J 1/1412; A61J 1/1475; A61J 9/00; A61J 9/085;
(Continued)

(56) References Cited

U.S. PATENT DOCUMENTS 3,138,278 A * 6/1964 Butts ..... A61J 9/04 215/11.1
3,554,399 A * 1/1971 Chapman ..... A61J 11/00 215/11.6

(Continued)

FOREIGN PATENT DOCUMENTS

DE 25 09 504 9/1976
DE 44 25 433 2/1996

OTHER PUBLICATIONS

International Search Report (ISR) issued Jan. 15, 2014 in International (PCT) Application No. PCT/EP2013/001149.

*Primary Examiner* — Robert J Hicks
(74) *Attorney, Agent, or Firm* — Wenderoth, Lind & Ponack, L.L.P.

(57) ABSTRACT

A storage or infusion bottle (1) has an integrally molded bottle neck (3) with a teat-shaped bottle feature (4, 5) projecting from its mouth end. The closed teat end wall (6, 7) of the bottle feature is puncturable by an infusion needle. A cap (8) is attachable to the bottle neck (3) and has a funnel-shaped cap feature (9, 10) with an interior space accommodating the free end region of the bottle feature (4, 5). The intermediate space between the end wall of the bottle feature (4, 5) and the opposing side of the cap feature (9, 10) is completely filled by a hat-shaped sealing element (11, 12) enclosing the bottle feature (4, 5) at least in its end region remote from the bottle (1).

12 Claims, 1 Drawing Sheet

(58) Field of Classification Search
CPC ..... A61J 9/08; A61J 1/1493; B65D 45/16; B65D 51/1644
USPC ..... 215/11.5, 11.4, 11.6, 11.1, 228, 43, 297; 220/324, 315, 203.02, 203.01, 212
See application file for complete search history.

(56) References Cited

U.S. PATENT DOCUMENTS

| | | | | |
|---|---|---|---|---|
| 4,174,238 | A | 11/1979 | Fowles et al. | |
| 4,558,792 | A * | 12/1985 | Cabernoch | B29C 66/723 215/11.3 |
| 4,706,827 | A * | 11/1987 | Cabernoch | A61J 9/001 215/11.1 |
| 5,451,374 | A | 9/1995 | Molina | |
| 2002/0040856 | A1 * | 4/2002 | Mollstam | A61J 9/00 206/222 |
| 2005/0051572 | A1 | 3/2005 | Vogel et al. | |

* cited by examiner 9
10
1
8
18

15
16
12
A-A
11
9
13
6
7
10
8
4
5
14
3
17
18

1
15
16
18
10
9

1
18
9 15
10
A B
BA
16

11
9
15
16
10
12
B-B
4
5
18
8
17

STORAGE OR INFUSION BOTTLE

FIELD OF THE INVENTION

The present invention relates to a storage or infusion bottle with a bottle neck moulded integrally thereon. The bottle neck has at least one teat-shaped bottle feature projecting from its mouth end. The closed teat end wall of the bottle feature is designed to be puncturable by an infusion needle.

BACKGROUND OF THE INVENTION

Storage or infusion bottles, which are mostly intended for a pharmaceutical fluid that has to be kept sterile, are also referred to as blow-fill-seal bottles, reflecting the process steps that are in immediate succession during a manufacturing process. In the case of these storage or infusion bottles, the fluid is filled into them immediately after the plastic bottle has been blown, to subsequently close this bottle as one piece also at the free mouth end of its bottle neck. In as far as a cap is attached to this storage or infusion bottle, such a cap primarily serves as an attachment point for the required infusion equipment. In preparation for an infusion, the cap, the end wall provided at the free end of the bottle neck, and the intermediate space remaining between this cap and the end wall need to be punctured by the infusion cannula for the fluid to be subsequently extractable, for instance drop by drop, from the bottle via this cannula.

Since a cap, which on its inside has a seal disc, made from a rubber-like material for the purpose of puncturing, is attached to the mouth end of the bottle neck of traditional blow-fill-seal bottles, and since an intermediate space remains between the mouth end of the bottle neck of the traditional blow-fill-seal bottles on the one hand and the cap attached to said mouth end on the other hand, a dead space is created in this intermediate space. Into this dead space, leaking fluid flows along the outside of the cannula during the extraction process. That fluid is not subsequently extractable again from the dead space via the cannula. This leakage not only leads to the sterile fluid not being fully usable, but also, the dosing of any drug is complicated by the residual amount of leaked fluid remaining between mouth end of the bottle neck and cap.

DE 44 25 433 C1 discloses a storage bottle designed to accommodate a medical fluid. The known storage bottle has a closure with a cap, a cup-shaped feature with a relatively small diameter projecting from the end wall of the cap. A separately produced, disc-shaped elastic sealing element is inserted from the inside of the cap into this cup-shaped feature. This sealing element has an annular flange on the circumference at its end facing away from the feature. Once the separately produced sealing element has simply been placed into the cup-shaped feature, the sealing element, by its annular flange, can be welded to the inside of the cap. However, when piercing the sealing element with an infusion needle, there is the risk that, prior to puncturing the end wall closing the bottle neck, the needle tip initially deforms this end wall in such a way that a dead space is created between the bottle and the cap attached to it, resulting in the disadvantages mentioned above with regard to an insufficient emptying of the contents of the bottle and an incorrect dosing of the respective drug.

SUMMARY OF THE INVENTION

The problem addressed by the invention involves providing a storage or infusion bottle of the aforementioned type that facilitates an at least substantially complete extraction of the fluid stored therein and thus also a correct dosing.

The solution according to the invention to this problem in the storage or infusion bottle of the type mentioned at the outset lies in particular in that a cap is attachable to the bottle neck, with the cap having at least one funnel-shaped cap feature. Its feature interior space accommodates at least the free end region of the corresponding bottle feature. The intermediate space between the end wall of the at least one bottle feature and the opposing side of the corresponding cap feature is completely filled by a hat-shaped sealing element that encloses the bottle feature at least in its end region facing away from the storage or infusion bottle and that is held at the circumference of its hat shape in a form-fitting and/or force-fitting manner on the circumference of the bottle feature.

The storage bottle according to the invention has a bottle neck moulded integrally thereon. At least one bottle feature, which is teat-shaped and is thus smaller than the cross section of the mouth end of the bottle neck, projects from the mouth end of the bottle neck. The closed teat end wall of that bottle feature is designed to be puncturable by an infusion needle. A cap, onto which the usual infusion equipment or similar extraction equipment is mountable, is attachable to the bottle neck. This cap has at least one funnel-shaped cap feature, with its feature interior space accommodating at least the free end region of the corresponding bottle feature. A hat-shaped sealing element completely fills the intermediate space between the end wall of the at least one bottle feature and the opposing side of the corresponding cap feature. The sealing element encloses the bottle feature at least in its end region facing away from the storage or infusion bottle. This sealing element is held at the circumference of its hat shape in a form-fitting and/or force-fitting manner on the circumference of the bottle feature. Since the sealing element completely fills the intermediate space between the end wall of the bottle neck feature and the opposing side of the corresponding cap feature, an intermediate space is avoided. Since the content of the bottle is extracted via the teat-shaped bottle feature, since this bottle feature has a smaller diameter or cross section as compared to the end wall forming the base of the bottle neck, and since during piercing of the end wall of the bottle feature this end wall, which is relatively small in cross section, is less prone to distortion, the forming of an undesirable dead space is also not to be expected during piercing by the infusion needle. Since the sealing element with its hat shape encloses the bottle feature at least in its end region facing away from the storage or infusion bottle and is held at its internal circumference in a form-fitting or force-fitting manner on the circumference of the bottle feature, a relatively large amount of leaking fluid cannot run out from the bottle opening punctured by the infusion needle. In this way, in the case of the bottle according to the invention, an at least substantially complete extraction of the fluid stored therein, and thus, a correct dosing can be ensured.

To be able to mount the required infusion needle on the storage bottle according to the invention and to nevertheless be able, for instance, to add another active ingredient to the stored fluid, at least two bottle features can project from the bottle neck. Each of these bottle features is accommodated by a corresponding cap feature.

A preferred embodiment, in which the sealing element mounted on the at least one bottle feature effectively prevents the discharge of leaking fluid, the hat-shaped sealing element/sealing elements is/are each held on the corresponding bottle feature by a latching connection.

In this context, advantageously every sealing element, on the interior circumference of its hat shape, or every bottle feature, on its circumference, has at least one latching projection that interacts with a corresponding latching groove on the respective other component.

The puncturing by an infusion needle is facilitated, and at the same time any damage of the storage bottle hazardous to the sterility of the bottle content is effectively prevented, if at least one cap feature has a puncture opening that is preferably closed by a tear-away or a tear-off cover element.

A preferred embodiment according to the invention, which also ensures a simple assembly of the storage bottle according to the invention, provides that the at least one hat-shaped sealing element is held by bonding in the at least one cap feature.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figures 1, 2, 3, 4, 5:
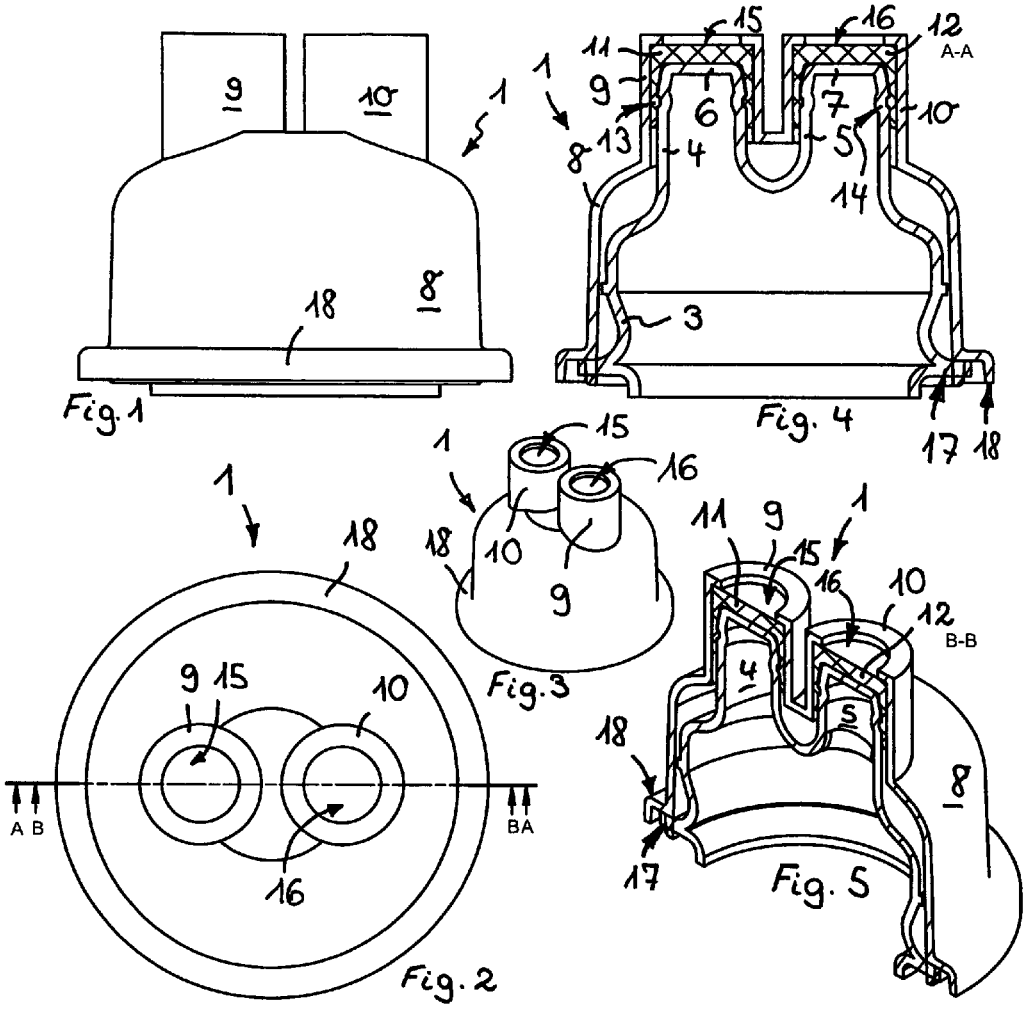
FIG. 1 is a side view of a storage bottle in the region of its bottle neck which bears a cap according to an exemplary embodiment of the invention.
FIG. 2 is a top plan view of the storage bottle of FIG. 1, looking onto the cap located on the bottle neck of the bottle.
FIG. 3 is a perspective view of the storage bottle of FIGS. 1 and 2.
FIG. 4 is a side view in section of the storage bottle of FIGS. 1 to 3 taken along the plane A-A according to FIG. 2.
FIG. 5 is a perspective view in section of the storage bottle of FIGS. 1 to 4 taken along the plane B-B according to FIG. 2.

FIGS. 1 to 5 illustrate a storage or infusion bottle 1 in the region of its bottle neck 3 that bears a cap 8. The storage bottle 1 is embodied as a blow-fill-seal bottle, in which the content of the bottle is enclosed in a sealed and sterile manner on all sides by the one-piece walling or wall of the bottle. The storage bottle 1 also has a closed bottle walling at the end wall of its bottle neck 3. At least one bottle feature or projection 4, 5 is teat-shaped and smaller than the cross section of the mouth end of the bottle neck and projects from the mouth end of bottle neck teat 3. The closed teat end wall of the bottle feature is designed to be puncturable by an infusion needle. A cap 8 is attachable to the bottle neck 3, onto which cap the usual infusion equipment or similar extraction equipment is mountable. This cap 8 has at least one funnel-shaped cap feature or projection 9, 10, with its feature interior space accommodating at least the free end region of the corresponding bottle feature 4, 5. A hat-shaped sealing element 11, 12 completely fills the intermediate space between the end wall 6, 7 of the at least one bottle feature 4, 5 and the opposing side of the corresponding cap feature 9, 10. The sealing element 11, 12 encloses the bottle feature 4, 5 at least in its end region facing away from the storage bottle 1. This sealing element 11, 12 is held at the circumference of its hat shape in a form-fitting and/or force-fitting manner on the circumference of the bottle feature 4, 5. Since the sealing element 11, 12 completely fills the intermediate space between the end wall of the bottle feature 4, 5 and the opposing side of the corresponding cap feature 9, 10, an intermediate space is avoided.

As clearly evident in the longitudinal sections according to FIGS. 4 and 5, the storage bottle 1 has two teat-shaped bottle features 4, 5 on the mouth end of its bottle neck 3. Each of these bottle features 4, 5 projects into a funnel-shaped cap feature 9, 10. In each case one hat-shaped sealing element is provided and preferably held by bonding in every cap feature 9, 10. The sealing element 11, 12 densely encloses the corresponding bottle feature 4, 5 such that the intermediate space between the cap feature 9, 10 and the bottle feature 4, 5 is completely filled and free of dead space.

Since the bottle content is extracted via the teat-shaped bottle feature 4, 5, since the bottle feature 4, 5 has a smaller diameter or cross section as compared to the end wall forming the base of the bottle neck 3, and since during piercing of the end wall of the bottle feature 4, 5 this end wall, which is relatively small in cross section, is less prone to distortion. The forming of an undesirable dead space is also not to be expected during piercing by the infusion needle. Since the sealing element 11, 12 with its hat shape encloses the bottle feature 4, 5 at least in its end region facing away from the storage or infusion bottle 1 and is held at its internal circumference in a form-fitting and/or force-fitting manner on the circumference of the bottle feature 4, 5, a relatively large amount of leaking fluid cannot run or flow out from the bottle opening punctured by the infusion needle. In this way, in the case of the storage bottle 1 illustrated, a complete extraction of the fluid stored therein, and thus, a correct dosing can be ensured.

As well recognizable in FIG. 4, the hat-shaped sealing elements 11, 12 are each held on the corresponding bottle feature 4, 5 by a latching connection. For this purpose, every sealing element 11, 12 has on the interior circumference of its hat shape a latching projection 13 that interacts with a corresponding latching groove 14 on the outer circumference of the corresponding bottle feature 4, 5.

A comparison between the FIGS. 2, 3 and 5 elucidates that each of the funnel-shaped cap features 9, 10 has a puncture opening 15, 16. Not shown here is that these puncture openings 15, 16 may each be closed by a tear-away or tear-off cover element or cover.

A comparison between the FIGS. 4 and 5 shows that an annular flange 17 projects from the bottle neck 3 of the storage bottle 1. The cap 8, which is approximately dome-shaped, is attachable to the bottle neck 3 of the storage bottle 1 at the point at which the margin of the cap circumference 18, which here is folded around in the shape of an edge of a plate, lies on the annular flange 17. To captively connect the cap 8 with the storage bottle 1, the margin of the cap circumference 18 may be non-detachably connected to the annular flange 17 by welding or the like.

While one embodiment has been chosen to illustrate the invention, it will be understood by those skilled in the art that various changes and modifications can be made therein without departing from the scope of the invention as defined in the claims.

LIST OF REFERENCE SIGNS

1 Storage bottle
3 Bottle neck
4 Bottle feature
5 Bottle feature
6 Teat end wall (of the bottle feature 4)

7 Teat end wall (of the bottle feature 5)
8 Cap
9 Cap feature
10 Cap feature
11 Sealing element
12 Sealing element
13 Latching projection
14 Latching groove
15 Puncture opening
16 Puncture opening
17 Annular flange
18 Margin of cap circumference

The invention claimed is:

1. A storage or infusion bottle, comprising:

a bottle body with a bottle neck integrally molded to said bottle body, said bottle neck having a mouth end;

a teat-shaped first bottle projection extending from said mouth end and being integrally molded with said bottle neck, said first bottle projection having a closed teat end wall puncturable by an infusion needle;

a cap being attached to said bottle neck and having a funnel-shaped first cap projection with an interior space receiving at least a free end of said first bottle projection, said first cap projection having an end portion at a free axial end thereof;

a first intermediate space between said end portion of said first cap projection and said end wall of said first bottle projection; and a hat-shaped first sealing element enclosing at least an end region of said first bottle projection facing away from said bottle body and being held on a circumference of said first bottle projection in at least one of a form-fitting or force-fitting manner, said first sealing element completely filling said first intermediate space.

2. A storage or infusion bottle according to claim 1 wherein a teat-shaped second bottle projection extends from said mouth end and is integrally molded with said bottle neck, said second bottle projection having a closed teat end wall puncturable by an infusion needle;

said cap has a funnel-shaped second cap projection with an interior space receiving at least a free end of said second bottle projection, said second cap projection having an end portion at a free axial end thereof;

a second intermediate space is between said end portion of said second cap projection and said end wall of said second bottle projection; and a hat-shaped second sealing element encloses at least an end region of said second bottle projection facing away from said bottle body and being held on a circumference of said second bottle projection in at least one of a form-fitting or force-fitting manner, said second sealing element completely filling said second intermediate space.

3. A storage or infusion bottle according to claim 2 wherein said first and second sealing elements are held on said first and second bottle projections by first and second latching connections, respectively.

4. A storage or infusion bottle according to claim 3 wherein each said latching connection comprises a latching projection on one of the respective sealing element or the respective bottle projection and comprises a corresponding groove on the other of the respective sealing element or the respective bottle projection.

5. A storage or infusion bottle according to claim 2 wherein each said free end of each said cap projection has a puncture opening therein.

6. A storage or infusion bottle according to claim 5 wherein each said puncture opening is closed by a removable cover.

7. A storage or infusion bottle according to claim 2 wherein each said sealing element is bonded to the respective bottle projection.

8. A storage or infusion bottle according to claim 1 wherein said first sealing element is held on said first bottle projection by a first latching connection.

9. A storage or infusion bottle according to claim 8 wherein said first latching connection comprises a latching projection on one of said sealing element or said first bottle projection and comprises a correspondingly shaped groove on the other of said first sealing element or said first bottle projection.

10. A storage or infusion bottle according to claim 1 wherein said free end of said first cap projection has a puncture opening therein.

11. A storage or infusion bottle according to claim 10 wherein said puncture opening is closed by a removable cover.

12. A storage or infusion bottle according to claim 1 wherein said first sealing element is bonded to said first bottle projection.

* * * * *